US007921570B1

(12) United States Patent
Pulkrabek et al.

(10) Patent No.: US 7,921,570 B1
(45) Date of Patent: Apr. 12, 2011

(54) EYE ALIGNMENT ASSEMBLY FOR TARGETING SYSTEMS

(75) Inventors: Larry Pulkrabek, Osceola, IA (US); Jay Engstrom, Port Wing, WI (US); Bill Pedersen, Duluth, MN (US); Matt Hass, Oakdale, MN (US)

(73) Assignee: Field Logic, Inc., Superior, WI (US)

( * ) Notice: Subject to any disclaimer, the term of this patent is extended or adjusted under 35 U.S.C. 154(b) by 0 days.

(21) Appl. No.: 12/684,775

(22) Filed: Jan. 8, 2010

(51) Int. Cl.
*F41G 1/467* (2006.01)

(52) U.S. Cl. ..... 33/265; 124/87

(58) Field of Classification Search ..... 33/265; 124/87, 88
See application file for complete search history.

(56) References Cited

U.S. PATENT DOCUMENTS

| | | | |
|---|---|---|---|
| 4,400,887 | A | 8/1983 | Mason |
| 4,764,011 | A | 8/1988 | Goldstein |
| 4,928,394 | A | 5/1990 | Sherman |
| 5,080,084 | A | 1/1992 | Kendall et al. |
| 5,157,839 | A | 10/1992 | Beutler |
| 5,168,631 | A | 12/1992 | Sherman |
| 5,201,124 | A | 4/1993 | Sherman |
| 5,231,765 | A | 8/1993 | Sherman |
| 5,303,479 | A | 4/1994 | Rudovsky |
| 5,308,986 | A | 5/1994 | Walker |
| 5,338,037 | A | 8/1994 | Toyohara |
| 5,384,966 | A | 1/1995 | Gibbs |
| 5,420,959 | A | 5/1995 | Walker et al. |
| 5,442,861 | A | 8/1995 | Lorocco |
| 5,606,638 | A | 2/1997 | Tymianski et al. |
| 5,638,604 | A | 6/1997 | Lorocco |
| 5,649,526 | A | 7/1997 | Ellig |
| 5,685,081 | A | 11/1997 | Winegar |
| 5,850,700 | A | 12/1998 | Capson et al. |
| 5,862,603 | A | 1/1999 | Ellig |
| RE36,266 | E | 8/1999 | Gibbs |
| 5,956,854 | A | 9/1999 | Lorocco |
| 6,000,141 | A | 12/1999 | Afshari |
| 6,016,608 | A | 1/2000 | Lorocco |
| 6,122,833 | A | 9/2000 | Lorocco |
| 6,216,352 | B1 | 4/2001 | Lorocco |
| 6,311,405 | B1 | 11/2001 | Slates |
| 6,360,472 | B1 | 3/2002 | Lorocco |
| 6,385,855 | B1 | 5/2002 | Tymianski |
| 6,421,946 | B1 | 7/2002 | Lorocco |
| 6,477,778 | B1 | 11/2002 | Lorocco |
| 6,477,780 | B2 | 11/2002 | Aldred |
| 6,557,291 | B2 | 5/2003 | Hoadley |
| 6,560,884 | B1 | 5/2003 | Afshari |
| 6,564,462 | B1 | 5/2003 | Henry |

(Continued)

OTHER PUBLICATIONS

Vital Gear 2007 Product Catalog.

(Continued)

*Primary Examiner* — G. Bradley Bennett
(74) *Attorney, Agent, or Firm* — Stoel Rives LLP

(57) ABSTRACT

An eye alignment assembly for targeting systems. A sight point of an optical fiber is positioned within a housing behind an alignment indicia on a lens. An adjustment system permits the sight point of the optical fiber to be repositioned relative to the alignment indicia on the lens. The eye alignment assembly provides an indication of orientation of a user's eye in the pitch and yaw directions relative to the housing. The eye alignment assembly can be a discrete component or integrated into a targeting system, such as a bow sight.

30 Claims, 11 Drawing Sheets

U.S. PATENT DOCUMENTS

| | | | | |
|---|---|---|---|---|
| 6,571,482 | B1 | 6/2003 | Tymianski | |
| 6,581,317 | B1 | 6/2003 | Slates | |
| 6,634,110 | B2 | 10/2003 | Johnson | |
| 6,634,111 | B2 | 10/2003 | Lorocco | |
| 6,725,854 | B1 | 4/2004 | Afshari | |
| 6,796,037 | B1 | 9/2004 | Geffers et al. | |
| 6,802,129 | B1 | 10/2004 | Wirth | |
| 6,817,105 | B2 | 11/2004 | Lorocco | |
| 6,938,349 | B2 | 9/2005 | Afshari | |
| 6,981,329 | B1 | 1/2006 | Strathman | |
| 7,036,234 | B2 | 5/2006 | Rager | |
| 7,200,943 | B2 | 4/2007 | Afshari | |
| 7,290,345 | B2 | 11/2007 | Ellig | |
| 7,331,112 | B2 | 2/2008 | Gibbs | |
| 7,461,460 | B2 | 12/2008 | Priebe | |
| 7,464,477 | B2 | 12/2008 | Afshari | |
| 7,503,321 | B2 | 3/2009 | Afshari | |
| 7,562,486 | B2 | 7/2009 | Lorocco | |
| 7,574,810 | B1 | 8/2009 | Lorocco | |
| 7,574,811 | B2 | 8/2009 | Kurtzhals et al. | |
| 7,739,825 | B2 * | 6/2010 | LoRocco | 33/265 |
| 2002/0073560 | A1 * | 6/2002 | LoRocco | 33/265 |
| 2005/0193575 | A1 * | 9/2005 | Springer et al. | 33/265 |
| 2009/0199418 | A1 | 8/2009 | Lorocco | |
| 2009/0293855 | A1 * | 12/2009 | Danielson et al. | 124/87 |
| 2010/0258628 | A1 * | 10/2010 | Bay | 33/265 |

OTHER PUBLICATIONS

U.S. Appl. No. 12/726,594 entitled Eye Alignment Assembly, filed Mar. 18, 2010.

U.S. Appl. No. 12/791,503 entitled Bow Sight and Eye Alignment Assembly With Phosphorescent Fiber, filed Jun. 1, 2010.

* cited by examiner

EYE ALIGNMENT ASSEMBLY FOR TARGETING SYSTEMS

FIELD OF THE INVENTION

The present invention is directed to an eye alignment assembly for targeting systems, such as a bow sight. A sight point of an optical fiber is positioned within a housing behind an alignment indicia on a lens. An adjustment system permits the sight point of the optical fiber to be repositioned relative to the alignment indicia on the lens. The eye alignment assembly provides an indication of orientation of a user's eye in the pitch and yaw directions relative to the housing. The eye alignment assembly can be a discrete component or integrated into a targeting system.

BACKGROUND OF THE INVENTION

Bow sights range from simple pin markers to a vertically aligned series of pins mounted in a generally annular frame. Each pin corresponds to a particular distance to the target. The archer visually estimates the appropriate range and then sights to the target using the aiming pin corresponding to the estimated range.

Modern bow sights commonly use the illuminated end of an optical fiber as the sight point. The optical fiber absorbs ambient light through the side surfaces and projects the light out the end. The diameter of the optical fiber tended to be large in order for there to be enough surface area to gather sufficient light. The corresponding large size of the sighting end sometimes interferes with viewing of the target. Alternatively, a smaller diameter optical fiber can be used, but the length must be increased to add surface area to absorb light. It is preferred to wrap the excess optical fibers around a light transmitting structure to provide compactness.

The light conditions faced by hunters are highly variable in both intensity and color. If the sight is tuned for low light conditions, the amount of light projected by the optical fibers is too intense during high light conditions. Conversely, if the sight is tuned for high light conditions, not enough light will be absorbed and projected for low light conditions.

U.S. Pat. No. 7,290,345 discloses a pin sight that includes a light sensitive material, such as a photo chromic material, that regulates the amount of light absorbed by the optical fibers in proportion to the ambient light intensity in order to provide a more constant light intensity output.

Battery-powered lights used to selectively illuminate the pins solved the ambient light problem, but introduced the disadvantage of battery and light bulb failures. Battery-powered lights may also emit excessive light that may be seen by the quarry.

Even if these problems are overcome, the alignment of the shot can vary dramatically depending on where the archer positions his or her head, or more particularly, his or her shooting eye relative to the sight. If the archer's eye position varies from shot to shot, so will the accuracy and direction of each respective shot, leading to inconsistent or unpredictable shooting.

Peep sights are small devices which attach to the draw string on the bow and attempt to give the archer a consistent reference from which to position his or her eye. As noted in U.S. Pat. No. 5,850,700, there are numerous accuracy problems associated with mounting peep sights to a draw string, including, the draw string not being drawn the same exact distance each time and rotation of the draw string (and the peep sight) as it is drawn. The '700 patent proposes an eye alignment apparatus that assures that the archer's shooting eye is consistently positioned relative to the bow and the sight pins.

BRIEF SUMMARY OF THE INVENTION

The present invention is directed to an eye alignment assembly that provides an indication of orientation of a user's eye relative to a targeting system, such as for example a bow sight. The present eye alignment system can be a discrete component or can be integrated with the targeting system. In one embodiment, the eye alignment assembly is a component of a pin sight.

The eye alignment assembly includes a sight point of the optical fiber positioned behind an alignment indicia on a lens. An adjustment system permits the sight point of the optical fiber to be repositioned relative to the alignment indicia on the lens, without moving the whole assembly. The adjustment system permits the eye alignment assembly to be fixedly mounted to a target system or other structure, significantly simplifying the adjustment process for a particular user's shooting style.

In operation, the alignment indicia on the lens is aligned with the sight point on the optical fiber only when a user's eye is in a predetermined relationship with respect to the illuminated sight. The adjustment system permits adjustment of the position of the sight point of the optical fiber relative to the alignment indicia on the lens according to a particular user's shooting style. The eye alignment assembly provides an indication of orientation of the illuminated sight relative to a user's eye in both the pitch and yaw directions.

In one embodiment, the lens has a focal length and a magnification optimized for the distance between the user's shooting eye and the eye alignment assembly. The focal length and magnification of the lens permits the eye alignment assembly to be compact.

In the illuminated pin sight embodiment, the ends of optical fibers are used as sight points for both the pin sight and the eye alignment assembly. The optical fibers can be illuminated by ambient light and/or an on-board luminescent material that automatically supplements the ambient light in low light conditions.

The luminescent material is preferably located substantially within the frame. The filter blocks transmission of light having a wavelength of about 500 nanometers to about 565 nanometers. In one embodiment, the filter permits ultraviolet light to reach the luminescent material.

In one embodiment, a filter permits certain wavelengths of the electromagnetic spectrum to charge the luminescent material, but blocks the emission of at least a portion of the visible spectrum so the present bow sight is less visible downrange. The filter preferably blocks most or all of the visible spectrum. The present illumination system can be used with a single pin or a multi-pin sight.

The eye alignment assembly is preferably mounted to the frame of an illuminated sight. In one embodiment, the eye alignment assembly is aligned with a plurality of vertically aligned sight points. The eye alignment assembly is preferably located so a user can check alignment while viewing a target through the frame of the pin sight.

The present invention is also directed to an illuminated sight including a frame and at least one sight pin mounted to the frame. At least one optical fiber is attached to the sight pin. The sight pin includes at least one opening through which ambient light is gathered by the optical fiber and is transmitted to a sight point. A luminescent material is optically coupled to the at least one optical fiber. A filter covers at least a portion of the luminescent material so visible light emitted by the luminescent material is transmitted primarily along the optical fibers to the sight points, but permits at least a portion of the electromagnetic spectrum to penetrate the filter to charge the luminescent material. In one embodiment, at least two adjacent sight pins optionally have sight points with substantially zero separation.

DETAILED DESCRIPTION OF THE INVENTION

Figure 1B:
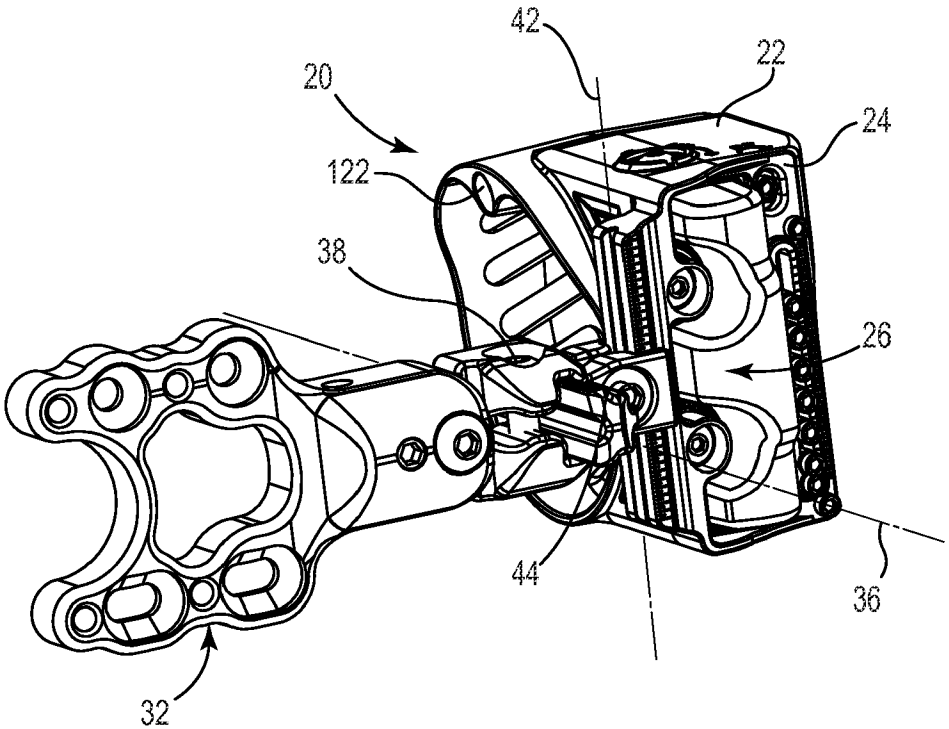
FIGS. 1A and 1B are perspective views of an illuminated sight in accordance with an embodiment of the present invention.
Figure 1A:
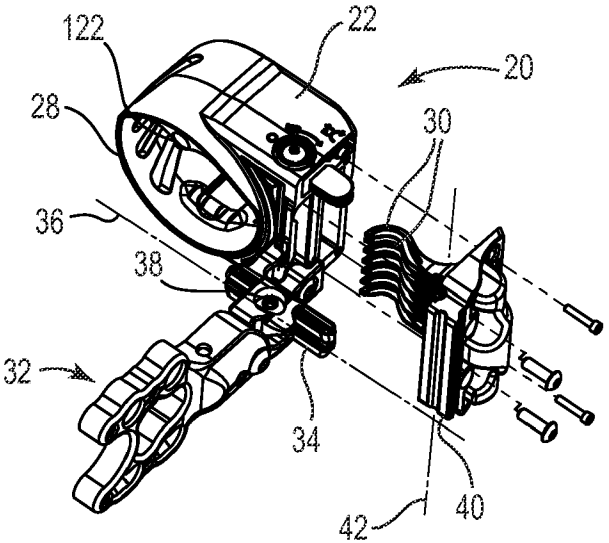

FIGS. 1A and 1B are perspective views of an illuminated sight 20 in accordance with an embodiment of the present invention. The illuminated sight 20 includes frame 22 with recess 24 (see also, FIG. 9B) sized to receive pin assembly 26 and guard 28 to protect sight pin array 30. Eye alignment assembly 122 is preferably located in a recess in the frame 22, as will be discussed in detail below.

Figure 9A:
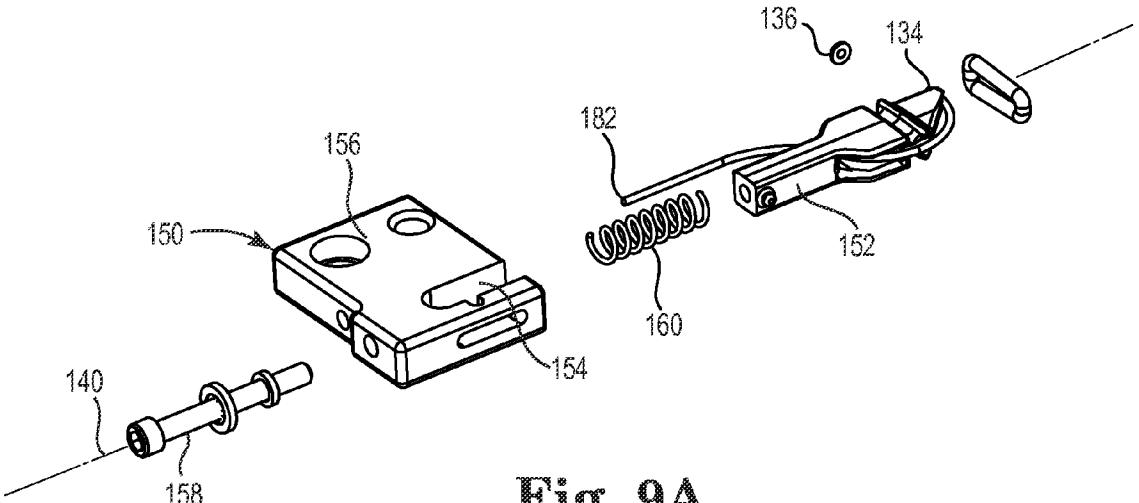
FIGS. 9A and 9B illustrate an eye alignment assembly in accordance with an embodiment of the present invention.
Figure 9B:
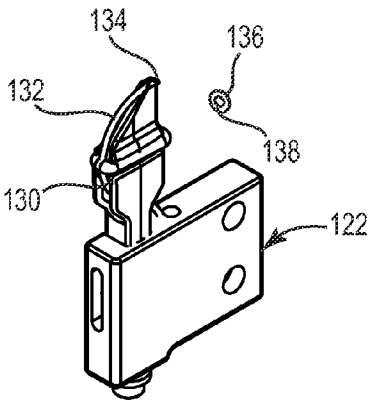

The eye alignment assembly 122 contemplated by this invention is not used as sighting or aiming device. Rather, the eye alignment assembly 122 is only used in combination with a sight, such as the illuminated sight 20. In fact, as best illustrated in FIG. 9B, the preferred frame 22 does not include an opening through which the archer can view a target through the eye alignment assembly 122.

The frame 22 is attached to the device to be aimed, such as for example a bow, by mounting assembly 32. First slide 34 permits adjustment of the frame 22 relative to the mounting assembly 32 along axis 36. Set screw 38 secures the frame 22 in the desired location. Second slide 40 permits adjustment of the frame 22 relative to the mounting assembly 32 along axis 42. Set screw 44 secures the frame 22 in the desired position.

Figure 2B:
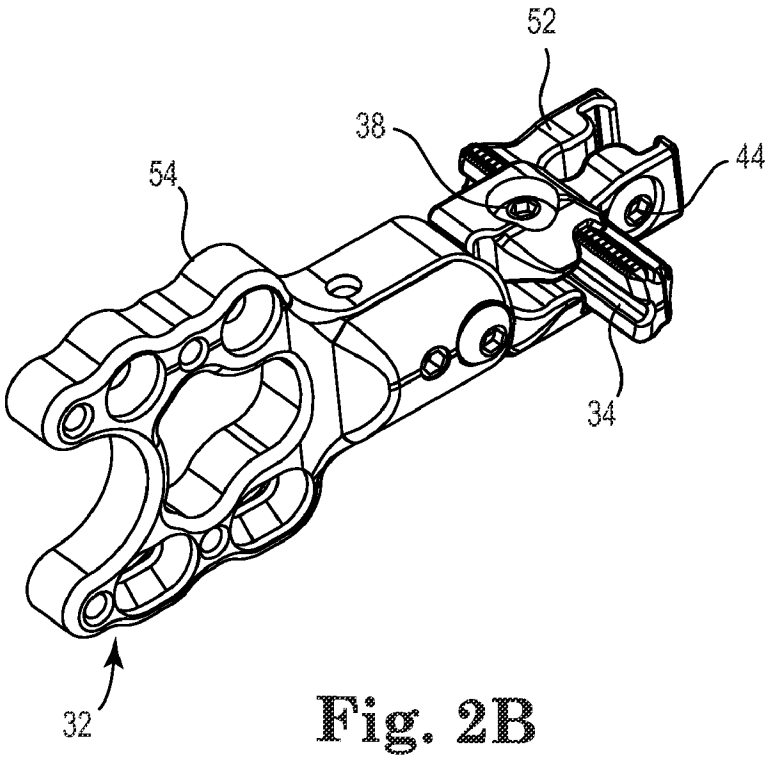
FIGS. 2A and 2B are perspective views of a mounting assembly for an illuminated sight in accordance with an embodiment of the present invention.
Figure 2A:
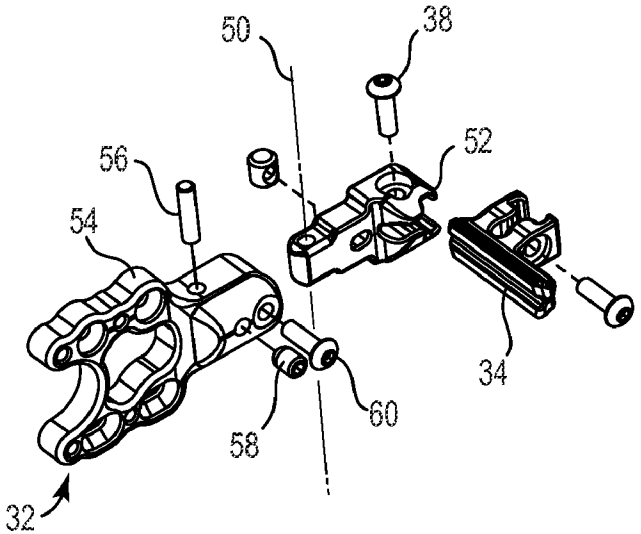

As best illustrated in FIGS. 2A and 2B, the mounting assembly 32 also permits the frame 22 to be rotated around axis 50. Sight portion 52 is attached to bow portion 54 of the mounting assembly 32 by pivot pin 56. Set screw 58 limits clockwise rotation of the sight portion 52 and screw 60 limits counterclockwise rotation. When attached to a conventional bow, the axis 50 is generally vertical and the frame 22 rotates in a generally horizontal plan.

Figure 2D:
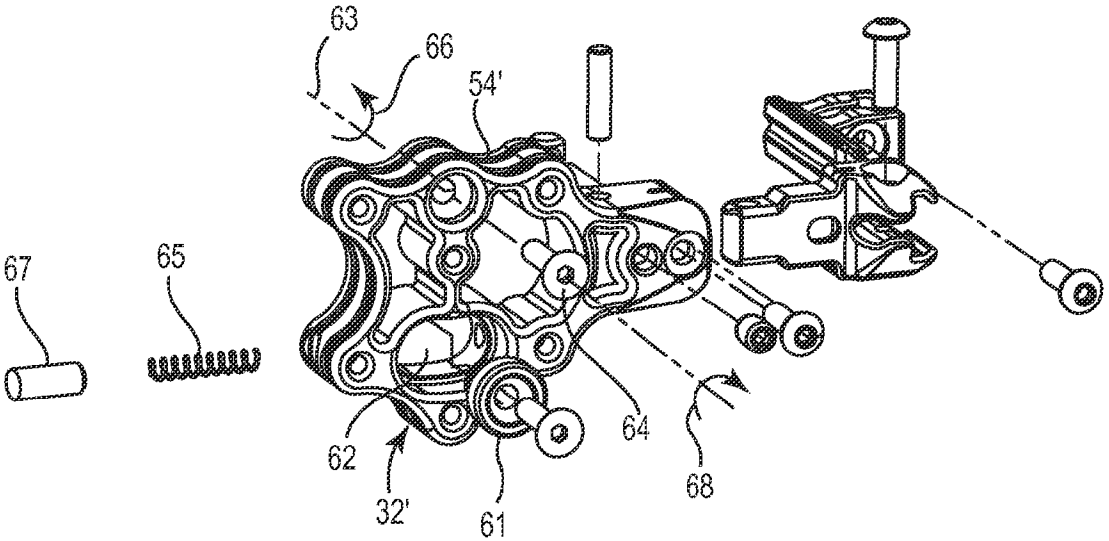
FIGS. 2C and 2D are perspective views of an alternate mounting assembly for an illuminated sight in accordance with an embodiment of the present invention.
Figure 2C:
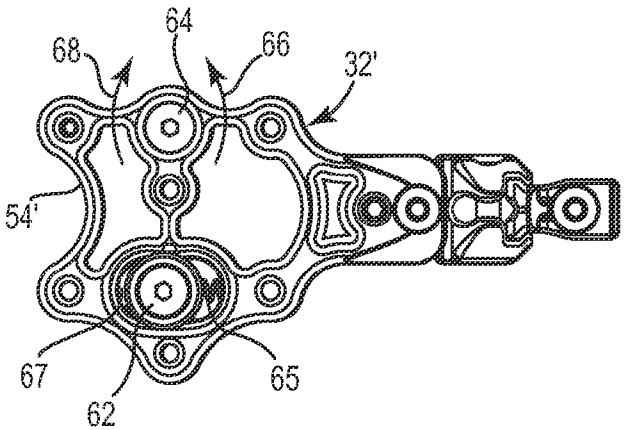

FIGS. 2C and 2D illustrate an alternate mounting assembly 32' in accordance with an embodiment of the present invention. Traveler 61 located in slot 62 permits the bow portion 54' to pivot around axis 63 of mounting screw 64. Spring 65 biases bow portion 54' in direction 66. Set screw 67 can be adjusted to move the bow portion 54' in the opposite direction 68, thereby controlling the position of the traveler 61 within the slot 62. The present mounting assembly 32' permits the user to precisely control the angle of rotation relative to the mounting hole on the bow. This adjustment is preferably made before adjusting the eye alignment assembly 122, discussed below.

Figure 3B:
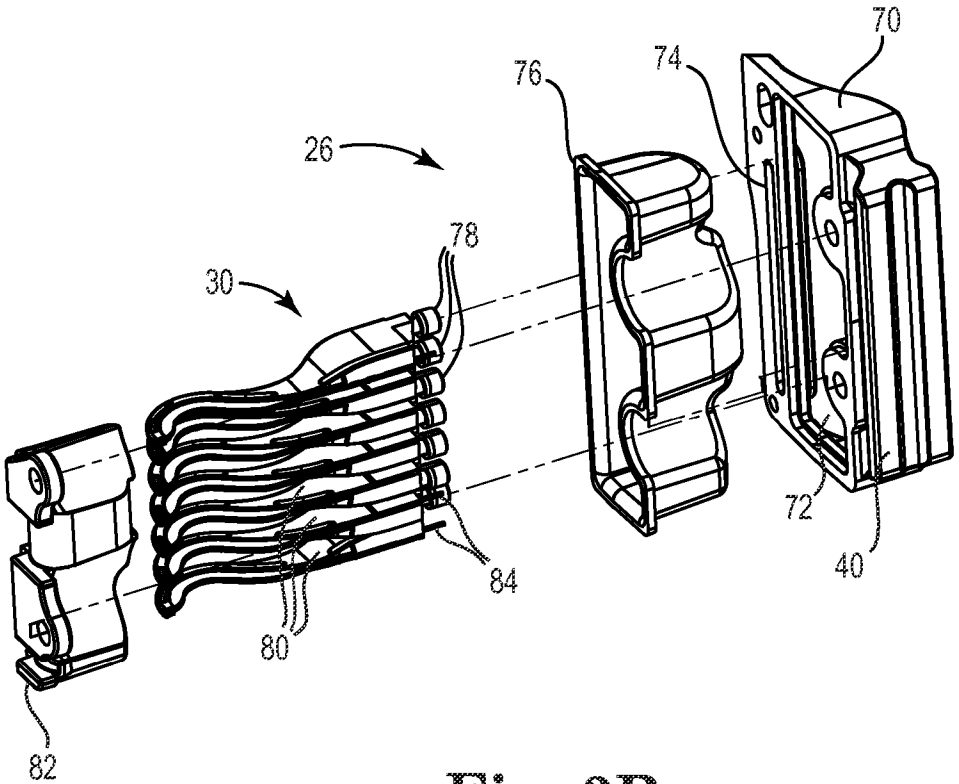
FIGS. 3A and 3B are perspective views of a pin assembly for an illuminated sight in accordance with an embodiment of the present invention.
Figure 3A:
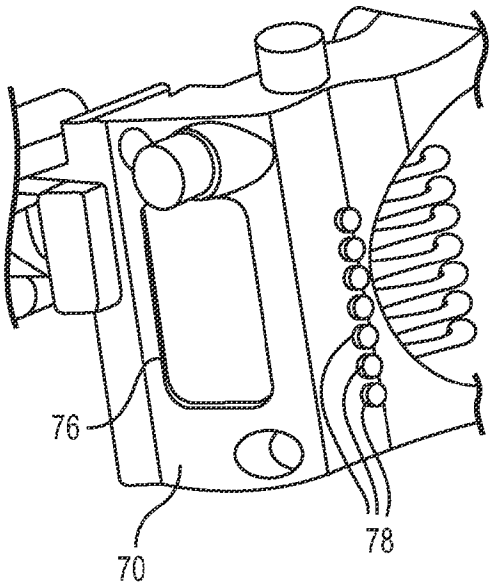
Figure 4B:
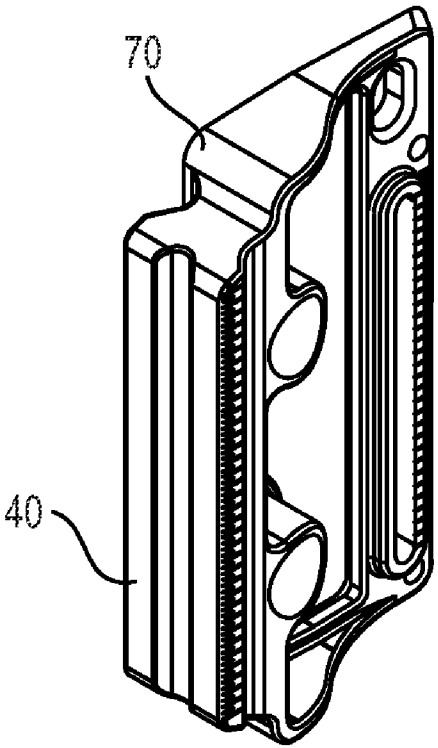
FIGS. 4A and 4B illustrate pin housing for the pin assembly of FIGS. 3A and 3B.
Figure 4A:
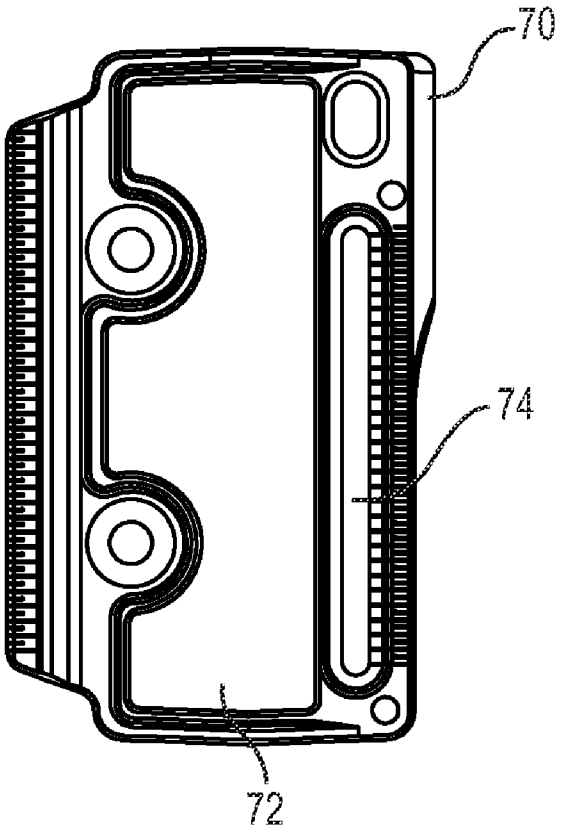

FIGS. 3A and 3B illustrate the pin assembly 26 in accordance with an embodiment of the present invention. As best illustrated in FIGS. 4A and 4B, pin housing 70 includes a primary opening 72 and a pin slot 74. The screws 78 permit adjustment of the individual pins 80 within the pin slot 74.

Filter 76 extends across primary opening 72. Screws 78 secure the individual sighting pins 80 in the sight pin array 30 to the pin slot 74. Luminescent material 82 is located behind or within the filter 76 and optically coupled to optical fibers 84 at proximal ends of the sighting pins 80. The filter 76 performs several functions. First, it permits passage of selected wavelengths of electromagnetic radiation to reach and charge the luminescent material 82. In order to prevent the charged luminescent material 82 from being visible down range, the filter 76 also blocks transmission of a portion of the visible spectrum. In the preferred embodiment, the filter 76 blocks transmission of most or all of the visible spectrum.

For example, the filter 76 may be made from polycarbonate with an additive that blocks light in the range of about 500 nanometers to about 565 nanometers, but permits passage of the ultraviolet portion of the spectrum. A typical human eye will respond to wavelengths from about 380 to about 750 nanometers, so some of the light that escapes through the filter will be visible downrange.

A variety of luminescent materials 82 are suitable for the present application, such as for example, a clear polycarbonate impregnated with 30% by volume of Ultra V10 Glow Powder available from Glow Inc. located in Severn, Md. The Ultra V10 Glow Powder is a strontium aluminate phosphorescent material with a particle size of about 55 micrometers to about 85 micrometers. The luminescent material is visible by the human eye more than 24 hours after the initial charge.

Figure 5B:
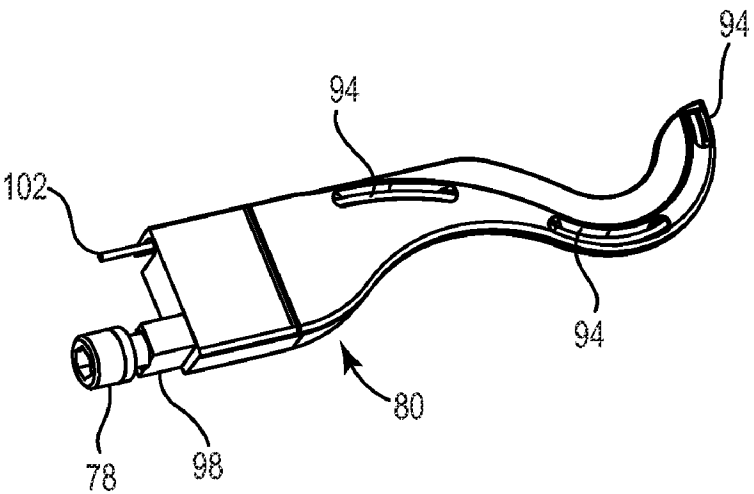
FIGS. 5A and 5B are perspective views of a sighting pin for an illuminated sight in accordance with an embodiment of the present invention.
Figure 5A:
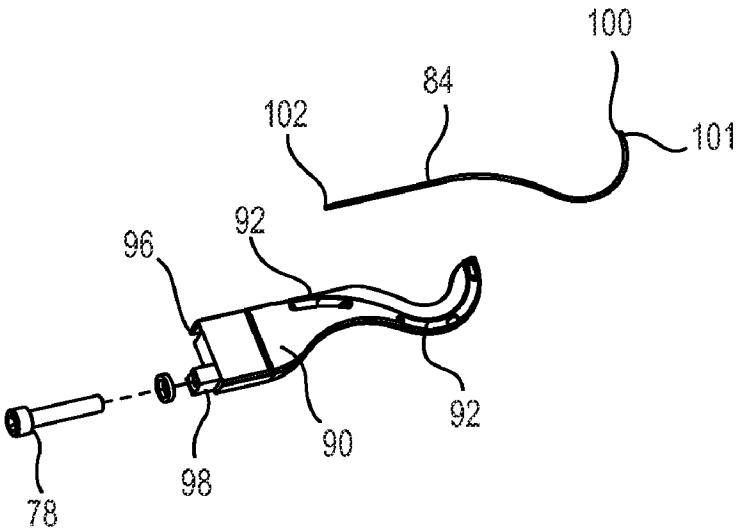
Figure 7A:
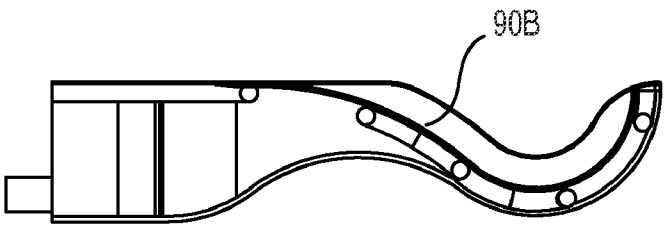
FIGS. 7A and 7B illustrate an alternate sight pin in accordance with an embodiment of the present invention.
Figure 7B:
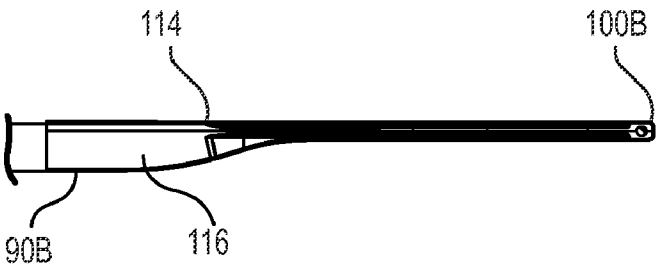

FIGS. 5A and 5B illustrate an individual sighting pin 80 of the sight pin array 30 in accordance with an embodiment of the present invention. Pin housing 90 includes channel 92 that retains optical fiber 84. The channel 92 includes a number of openings 94 that permit ambient light to reach the optical fiber 84, while the pin housing 90 protects the optical fiber 84 from damage. Proximal end 96 of the pin housing 90 includes a rectangular portion 98 that couples with pin slot 74 on the pin housing 70. Screw 78 engages with threads in the rectangular portion 98 to position the pin housing 70 in the pin slot 74.

Distal end 101 of the optical fiber 84 acts as the sight point 100. Proximal end 102 optically couples with the luminescent material 82. In the illustrated embodiment, the optical fiber is about five inches long with a diameter of about 0.0019 inches. Suitable optical fibers are available from NanOptics, Inc. located in Gainsville, Fla. The optical fibers 84 are preferably different colors to assist the user in distinguishing the different sighting pins 80 in the sight pin array 30.

The optical fibers 84 are illuminated in a variety of ways. First, the openings 94 permit that optical fiber 84 to gather ambient light. Second, the luminescent material 82 is optically coupled to proximal ends 102 of the optical fibers 84. Once the luminescent material 82 is charged, it will illuminate the sight point 100 for hours.

The present illuminated sight 20 automatically adapts to the lighting conditions. The brightness of the luminescent material 82 relative to daylight conditions is very low. Consequently, when ambient light is high the luminescent material contributes a relatively small percentage of the light delivered to the sight point 100. In low light conditions, however, the brightness of the luminescent material 82 is significant compared to the ambient light and the luminescent material contributes a relatively large percentage of the light delivered to the sight pin 100.

Figure 6A:
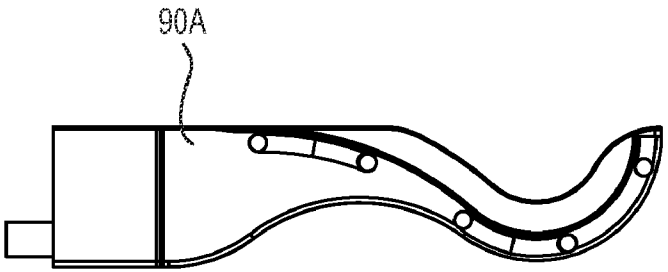
FIGS. 6A and 6B illustrate a sight pin in accordance with an embodiment of the present invention.
Figure 6B:
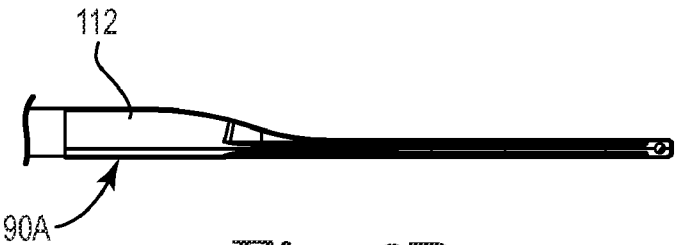

In one embodiment, two different styles of pin housing 90 are provided. As illustrated in FIGS. 6A-6C, pin housing 90A is molded with planar bottom surface 110 and reinforcing material 112 located above the planar bottom surface 110. Pin housing 90B, however, includes planar top surface 114 and reinforcing material 116 located below the planar top surface 114. Consequently, if pin housings 90A and 90B are stacked with their respective planar surfaces 110, 114 in contact, the sight points 100A, 100B can have substantially zero pin separation, while requiring only one pin slit 74 in the pin housing 70.

Figure 8:
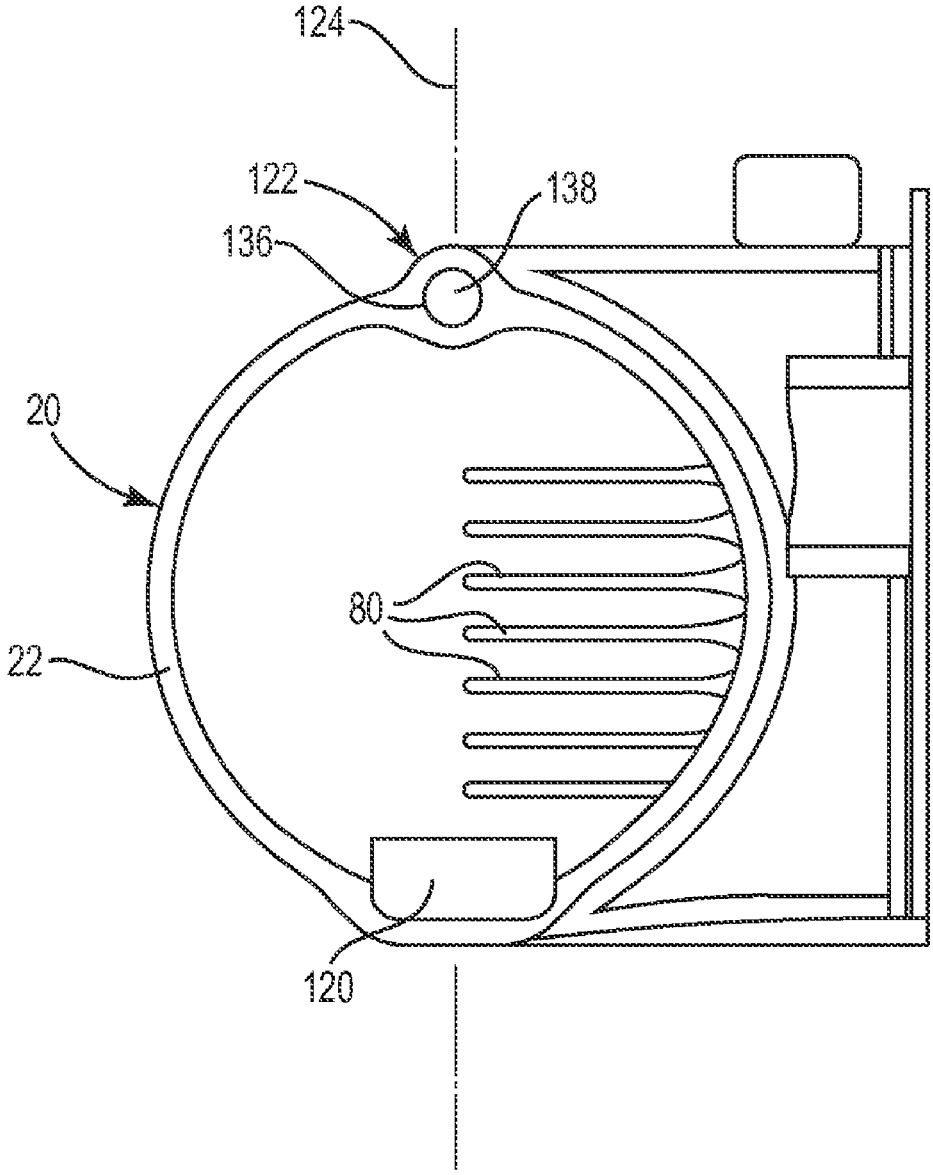
FIG. 8 is a front view of the illuminated sight of FIGS. 1A and 1B viewed from a user's perspective.

FIG. 8 is a rear view of the illuminated sight 20 as seen by the archer during use. The sighting pins 80 in the sight pin array 30 are visible within frame 22. Bubble level 120 is mounted in frame 22 to provide an indication of orientation of the sight 20 in the roll direction relative to horizontal.

Eye alignment assembly 122 is mounted in the frame 22 to provide an indication of orientation of the sight 20 in the pitch and yaw directions relative to the user's eye. Locating the eye alignment assembly 122 on the frame 22 permits the user to check alignment while viewing a target through opening 21 in the frame 22 that surrounds the sighting pins 80. The eye alignment assembly 122 is preferably located along axis 124 formed by the sight points 100.

In the illustrated embodiment, the eye alignment assembly 122 includes a lens 136 fixedly mounted to the frame 22. Consequently, alignment indicia 138 on the lens 136 is fixed relative to the sight 20. The initial alignment of the eye alignment assembly 122 relative to the sight 20 is preferably performed at the factory.

FIGS. 9A, 9B, 9C, and 9D illustrate an eye alignment assembly 122 in accordance with an embodiment of the present invention. Pin housing 130 supports optical fiber 132 so sight point 134 is generally aligned with the alignment indicia 138 on the lens 136. The sight point 134 serves as the second alignment indicia. The alignment indicia 138 can be a point, a circle, cross-hairs, or a variety of other configurations.

When alignment indicia 138 on lens 136 is aligned with sight point 134 on optical fiber 132, the user's eye is in a predetermined relationship with respect to the sight 20. That is, alignment indicia 138 and sight point 134 can only be viewed in a predetermined way from a predetermined approximate angle, assuring that the archer's shooting eye is consistently positioned relative to the illuminated sight 20.

The eye alignment assembly 122 permits adjustment of the position of the sight point 134 relative to indicia 138 on the lens 136 along axes 140, 142. FIG. 9A illustrates an assembly 150 that permits adjustment along the axis 140. Slide portion 152 of the pin housing 130 slides in slot 154 of the support block 156. Adjustment screw 158 and spring 160 permit adjustment of the pin housing 130 and the optical fiber 132 along the axis 140.

Figure 9C:
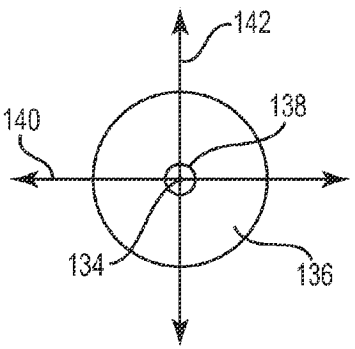
FIG. 9C is a plan view of an alignment indicia relative to a point sight for the eye alignment assembly of FIG. 9B.
Figure 9D:
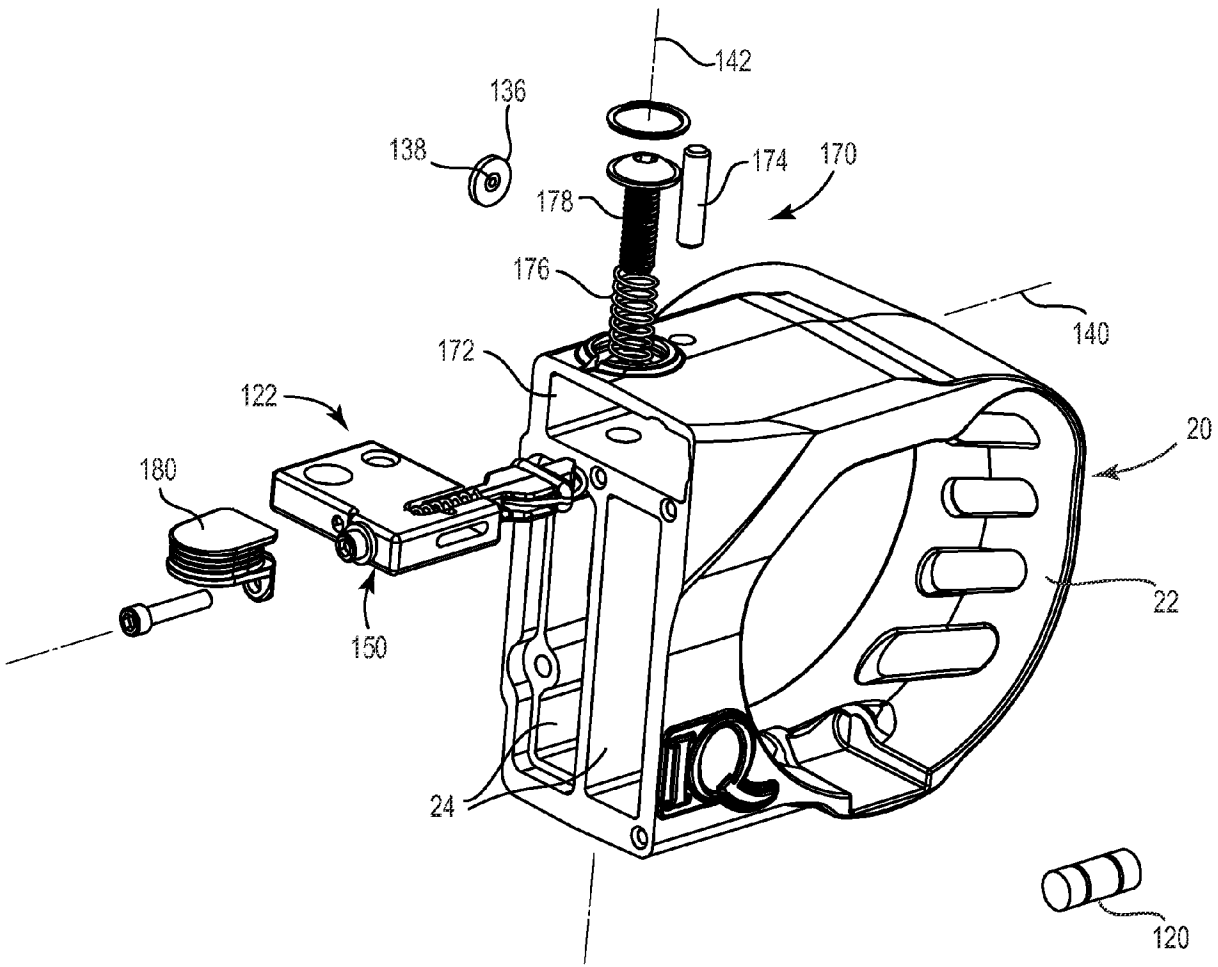
FIG. 9D is an exploded view of the eye alignment assembly of FIGS. 9A and 9B coupled to a sight in accordance with an embodiment of the present invention.

FIG. 9D illustrates adjustment mechanism 170 for the axis 142. The assembly 150 of FIG. 9A is positioned in recess 172 in the frame 22 so sight point 134 is located generally behind lens 136. Guide pin 174 retains the assembly 150 within the recess 172, but permits limited motion of the slide block 156 along the axis 142 within the recess 172. Spring 176 biases the support block 156 toward the bottom of the recess 172, while screw 178 permit the support block 156 to be raised and lowered within the recess 172.

As illustrated in FIG. 9C, rotating the screws 158, 176 moves the location of the sight point 134 relative to the indicia 138 on the lens 136 along the axes 140, 142 so the present eye alignment assembly 122 can be fine tuned for the particular shooting style of the user.

The lens 136 can have a convex or a concave curvature on both of its sides, with the specific configuration of the lens variables, such as for example, the radii of curvature of the respective surfaces, the index of refraction, and the thickness of the lens, determining its characteristics, such as its focal length and magnification. By manipulating these variables, it is possible to create a lens 136 in which the alignment indicia 138 is not visible or not in focus when viewed by a human eye that is not in the proper or desired location relative to the sight 20. Therefore, it is possible to make an eye alignment assembly 122 with a single alignment indicia.

In another embodiment, the lens 136 is coated with an opaque material that block light from the sight point 134, except in the center of the alignment indicia 138. Consequently, the user cannot see the sight point 134 unless he or her eye is in a predetermined relationship with respect to the sight 20.

Luminescent material 180 is optically coupled to proximal end 182 of the optical fiber 132. The luminescent material 180 is preferably the same as the material 82. As discussed above, filter 76 permits electromagnetic energy to enter the recess 172 to charge the material 180, but only permits a portion of the visible spectrum to escape. Alternatively, the proximal end 182 of the optical fiber 132 can be optically coupled to the luminescent material 82. Alternatively, the eye alignment assembly 122 can be the device disclosed in U.S. Pat. No. 5,850,700, which is hereby incorporated by reference. The present eye alignment assembly 122 can optionally be mounted to the frame of any pin sight.

Figure 10:
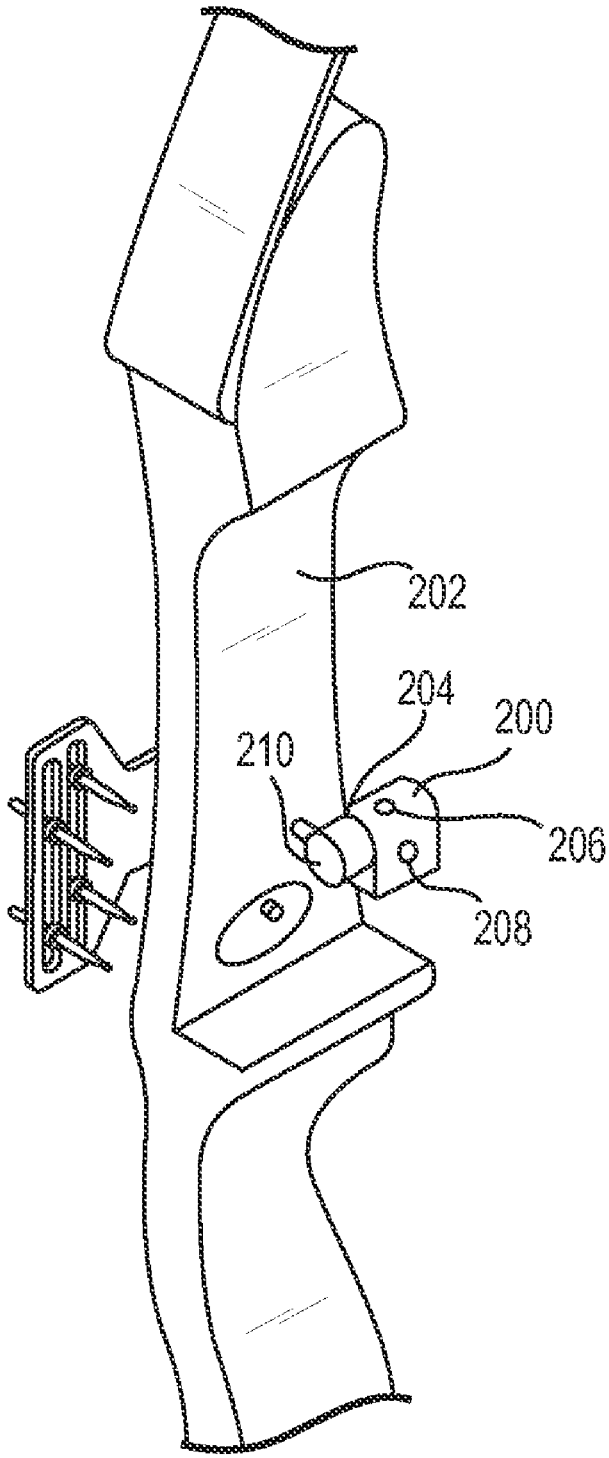
FIG. 10 is a perspective view of an eye alignment assembly mounted to a bow in accordance with an embodiment of the present invention.

FIG. 10 illustrates an embodiment of an eye alignment assembly 200 configured as a discrete component in accordance with an embodiment of the present invention. In the illustrate embodiment, the eye alignment assembly 200 is fixedly mounted to bow 202. Alternatively, the eye alignment assembly 200 can be mounted to a bow sight. The eye alignment assembly 200 includes tubular housing 204 that contains a pin housing 130 supporting an optical fiber 132 (see FIG. 9B).

Adjustment screws 206, 208 on the housing 204 permit adjustment of the position of the sight point 134 relative to indicia 138 on the lens 136 along the axes 140, 142 (see FIG. 9C). The eye alignment assembly 200 can be adjusted to provide an indication of orientation of a user's eye in the pitch and yaw directions relative to the bow 202, without needing to adjust the position of the housing 204.

The axes 140, 142 are preferably generally perpendicular and permit the position of the sight point 134 to be adjusted in 2-degrees of freedom. The down-range end 210 of the housing 204 is preferably sealed to prevent light from entering. In an alternate embodiment, the down-range end 210 may include a filter to permit a limited amount of light, or light of a particular wavelength or color, to enter the housing 204. For example, the sight point 134 can be a first color and the down-range end 210 permits only a second color of light to penetrate into the housing 204, thereby increasing the contrast.

Where a range of values is provided, it is understood that each intervening value, to the tenth of the unit of the lower limit unless the context clearly dictates otherwise, between the upper and lower limit of that range and any other stated or intervening value in that stated range is encompassed within the inventions. The upper and lower limits of these smaller ranges which may independently be included in the smaller ranges is also encompassed within the inventions, subject to any specifically excluded limit in the stated range. Where the stated range includes one or both of the limits, ranges excluding either both of those included limits are also included in the inventions.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. An eye alignment assembly comprising:

a housing comprising a sight point of an optical fiber positioned behind an alignment indicia on a lens; and an adjustment system adapted to reposition a sight point of the optical fiber relative to the alignment indicia on the lens, the eye alignment assembly providing an indication of orientation of a user's eye in the pitch and yaw directions relative to the housing.

2. The eye alignment assembly of claim 1 wherein the alignment indicia on the lens is aligned with the sight point on the optical fiber only when a user's eye is in a predetermined relationship with respect to the housing.

3. The eye alignment assembly of claim 1 comprising a luminescent material optically coupled to a proximal end of the optical fiber in the eye alignment assembly.

4. The eye alignment assembly of claim 3 wherein the luminescent material is located behind the filter so visible light emitted by the luminescent material is emitted primarily along the optical fiber.

5. The eye alignment assembly of claim 3 wherein the luminescent material is located behind the filter that blocks transmission of light having a wavelength of about 500 nanometers to about 565 nanometers.

6. The eye alignment assembly of claim 3 wherein the luminescent material is located behind the filter that permits penetration of ultraviolet light.

7. The eye alignment assembly of claim 1 wherein the adjustment system permits the sight point of the optical fiber to be adjusted in two degrees of freedom.

8. The eye alignment assembly of claim 1 wherein the lens is fixedly mounted to the housing.

9. The eye alignment assembly of claim 1 wherein a down-range end of the housing blocks entry of light into the housing.

10. The eye alignment assembly of claim 1 wherein a down-range end of the housing permits a single color of light to enter the housing.

11. The eye alignment assembly of claim 1 fixedly mounted to one of a bow or a bow sight, the eye alignment assembly providing an indication of orientation of a user's eye in the pitch and yaw directions relative to the bow.

12. A bow sight comprising:

a frame;

at least one sight pin mounted to the frame;

at least one optical fiber attached to the sight pin, the sight pin comprising at least one opening through which ambient light is gathered by the optical fiber and transmitted to a sight point; and the eye alignment assembly of claim 1 attached to the frame.

13. The bow sight of claim 12 wherein the eye alignment assembly is located within a recess in the frame.

14. The bow sight of claim 12 wherein the eye alignment assembly is located along an axis of sight points for a plurality of sight pins.

15. The bow sight of claim 12 comprising a plurality of sight pins mounted to the frame, at least two adjacent sight pins have sight points with substantially zero separation.

16. The bow sight of claim 12 comprising a luminescent material optically coupled to the at least one optical fiber attached to the sight pin, wherein the luminescent material is covered by the filter.

17. An illuminated sight comprising:

a frame;

at least one sight pin mounted to the frame;

at least one optical fiber attached to the sight pin, the sight pin comprising at least one opening through which ambient light is gathered by the optical fiber and transmitted to a sight point;

a luminescent material optically coupled to at least one of the optical fibers; and a filter covering at least a portion of the luminescent material that blocks at least a portion of the visible spectrum emitted by the luminescent material, while permitting at least a portion of the electromagnetic spectrum to penetrate the filter to charge the luminescent material.

18. The illuminated sight of claim 17 comprising a plurality of sight pins mounted to the frame, at least two adjacent sight pins have sight points with substantially zero separation.

19. The illuminated sight of claim 17 wherein the luminescent material is located substantially within the frame.

20. The illuminated sight of claim 17 wherein the filter blocks transmission of light having a wavelength of about 500 nanometers to about 565 nanometers.

21. The illuminated sight of claim 17 wherein ultraviolet light penetrates the filter.

22. The illuminated sight of claim 17 comprising an eye alignment assembly mounted to the frame.

23. The illuminated sight of claim 22 wherein the eye alignment assembly is aligned with a plurality of vertically aligned sight pins.

24. The illuminated sight of claim 22 wherein the eye alignment assembly provides an indication of orientation of the illuminated sight relative to a user's eye in pitch and yaw directions.

25. The illuminated sight of claim 22 wherein the eye alignment assembly is located so a user can check alignment while viewing a target through the frame.

26. The illuminated sight of claim 22 wherein the eye alignment assembly comprises a sight point of an optical fiber positioned behind an alignment indicia on a lens.

27. The illuminated sight of claim 26 wherein the alignment indicia on the lens is aligned with sight point on optical fiber only when a user's eye is in a predetermined relationship with respect to the illuminated sight.

28. The illuminated sight of claim 22 comprising an adjustment system for adjusting a position of the sight point of the optical fiber relative to the alignment indicia on the lens.

29. The illuminated sight of claim 22 wherein the optical fiber in the eye alignment assembly is optically coupled to the luminescent material.

30. The illuminated sight of claim 17 comprising a mounting bracket attaching the illuminated sight to the bow, the mounting bracket comprising:

a bow portion pivotally attached to the bow at a first location;

a slot in the bow portion;

a traveler located in the slot and attached to the bow at a second location, so the bow portion can pivot around the first location while the travel slides in the slot;

a spring biasing the bow portion is a first direction of rotation; and a set screw counteracting the bias of the spring to rotate the bow portion is a second opposite direction.

* * * * *